United States Patent [19]

Robinet et al.

[11] Patent Number: 4,968,934

[45] Date of Patent: Nov. 6, 1990

[54] MAGNETIC MARKING APPARATUS FOR MAGNETICALLY MEASURING DISPLACEMENT OF A MOVEABLE ELEMENT IN A WELL

[75] Inventors: Alain Robinet, Toulouse; Bernard Jacquet, Lyons, both of France

[73] Assignee: Societe Nationale Elf Aquitaine, Paris la Defense, France

[21] Appl. No.: 261,540

[22] Filed: Oct. 24, 1988

[30] Foreign Application Priority Data

Oct. 23, 1987 [FR] France ..... 87 14700

[51] Int. Cl.[5] ..... G01B 7/14; G01P 3/50; F04B 21/00

[52] U.S. Cl. ..... 324/207.22; 324/172; 324/206; 324/207.4; 417/63

[58] Field of Search ..... 324/171, 172, 179, 206, 324/207, 220, 207.22, 207.24; 166/250, 66.5; 417/63

[56] References Cited

U.S. PATENT DOCUMENTS 3,466,535 9/1969 Sterns et al. ..... 324/206
4,560,928 12/1985 Hayward ..... 324/207

FOREIGN PATENT DOCUMENTS 2164312 6/1973 Fed. Rep. of Germany ..... 324/179
191136 3/1967 U.S.S.R. ..... 324/206
818782 8/1959 United Kingdom ..... 324/172
1237728 6/1971 United Kingdom ..... 324/172

*Primary Examiner*—Gerard R. Strecker
*Attorney, Agent, or Firm*—Oblon, Spivak, McClelland, Maier & Neustadt

[57] ABSTRACT

Method and apparatus for the measurement of the displacement, and if desired, the force on movable equipment in the production pipe of a pumped well, for example, a pump rod or sucker rod near the pump at the bottom of a well. The force on the rod is measured with a load sensing device connected to a lower rod. The displacement is measured by creating equally spaced apart magnetic marks or poles on the internal wall of the production pipe, detecting the marks, and then erasing the marks, so they do not interfere with marks created and detected when the direction of displacement is reversed. A new mark is created each time a mark is detected, and the equal displacement distance between detected marks is compared with the corresponding elapsed time to determine the displacement and velocity of the rod. A diagram of force-displacement can be made from the measurement data to enable the pump, or other movable equipment to be operated at optimum conditions.

14 Claims, 3 Drawing Sheets

MAGNETIC MARKING APPARATUS FOR MAGNETICALLY MEASURING DISPLACEMENT OF A MOVEABLE ELEMENT IN A WELL

The present invention relates to a method and apparatus for measuring the displacement of movable equipment in the pipe of a well, for example, the displacement of pumping or sucker rods of a well pump within a production pipe.

BACKGROUND OF THE INVENTION

The measurement of displacement of movable equipment, such as a sucker rod, at the surface and the force or stress to which this rod is subjected are currently made and serve for the construction of a stroke-force diagram. The diagram of Leuter, is described, for example, in U.S. Pat. No. 4,583,915 Montgomery et al. The programs of calculation permit transposing the diagram construction by the use of values measured on the rod outside the well at the surface, which deviate considerably from those in the well, particularly on the bottom rod located immediately above the pump. It is this action of behavior of a lower rod which must be know to optimize pumping parameters. On different occasions, particularly where verification of position has been possible, or after rupture of the rod, it is apparent that transposing surface data to the portions moving in the well present many risks.

The measurement of the forces or stresses of the sucker rod at the bottom of the well is a known technique, and the transmission to the surface of the measurements made at the bottom can be done by a wire, by an acoustic system using the annular mud as the medium of propagation, or even storing the measurement data at the bottom in volatile memory (in english, Random Access Memory or R.A.M.) which is exploited after pulling the string of sucker rods.

Measurements of the displacement of the rod at the bottom of the well have been obtained in an experimental well by using a specially made section of production pipe and a proximity detector. The indications obtained are fed to the surface by a cable.

The use of a pipe, such as a production pipe, having markings on its internal wall constitutes a constraint which it is necessary to eliminate in order to make this technique workable. Such is the object of the present invention which has reduced the use of control equipment and pulling of the sucker rods or other movable equipment from the well.

SUMMARY OF THE INVENTION

In the method according to the invention, there is measuring of the displacement of movable equipment in the pipe of a well, in which successively:

there is created on the inner wall of the production pipe a first magnetic mark or pole using a first very brief excitation field with a polar axis orthogonal to the axis of the pipe, the first magnetic pole is detected with a field detector whose axis is orthogonal to the axis of the pipe, and simultaneously, a second magnetic mark or pole is created on the internal wall of the pipe using the same excitation field as previously, the polar axes of the excitation field and the field detector being spaced apart at a fixed distance, as a function of the geometry of the field detector, and rigid with the movable equipment, the first magnetic pole is erased with a first alternating field with a polar axis orthogonal to the pipe and spaced from the axis of the field detector, and additional magnetic marks are made and detected in the manner indicated above.

In a simplified mode of execution:

the change of the direction of displacement of the movable equipment is detected by observing the change of polarity of the detected field, where the polarity corresponds to a single direction of displacement of the detector.

In a preferred mode of execution:

all trace magnetism is erased from the inner wall of the pipe by a second alternating field whose polar axis is orthogonal to the axis of the pipe and at a fixed distance ahead of the polar axis of the first magnetic pole, at the same time that the first magnet pole is created on the inner wall of the pipe with a first excitation field having an axis orthogonal to the axis of the pipe, a second magnetic pole of opposite polarity to that of the first is created on the same wall with a second excitation field whose polar axis is symmetric to the first with respect to the polar axis of the field detector, and all traces of residual magnetism are erased with the first alternating field.

In the various embodiments of the method, the velocity of displacement of the movable equipment, such as a sucker rod, is determined by comparing the recorded spacing between the polar axes of the marks or excitation fields and the corresponding recorded interval of elapsed time between detection of the respective marks.

An apparatus according to the invention for measuring at the bottom, the displacement of movable equipment such as a sucker rod of a well pump in a production pipe comprises successively, fixed to the sucker rod or other movable equipment in the pipe:

first means for creating a magnetic pole or magnetic mark on the inner surface of the pipe, means for detecting the magnet mark and whose axis is orthogonal to the pipe and at a predetermined distance from the means for creating the magnetic mark, and first means for erasing the magnet pole or mark, and means for detecting the reversal of the direction of displacement of the movable equipment for reversing the operation of the means for creating the magnetic poles and the means to erase the magnets poles.

According to a preferred embodiment, the apparatus comprises in addition:

a second means for erasing the magnet poles from the internal wall of the pipe, positioned ahead of the first means for creating the magnet pole, and a second means for creating a magnet pole on the internal wall of the pipe, positioned between the detecting means and the first means for erasing the poles.

In other embodiments:

the first and second means for creating the magnetic pole on the internal wall of the pipe includes a magnet field inductor, energized for a very brief time and with a polar axis orthogonal to the pipe, and the first and second means for erasing the magnet poles include an alternating magnet field inductor, with a polar axis orthogonal to the pipe.

In accordance with the preferred embodiments the polar axes of the first and second means for creating the magnetic pole are symmetrical with respect to the axis of the means for detecting the magnetic pole, as are the axes of the first and second means for erasing the magnet poles.

Other advantages and characteristics of the invention will become evident from reading the description of a preferred embodiment of the invention, given as a non limiting example, with reference to the accompanying drawings.

DETAILED DESCRIPTION

Figure 1:
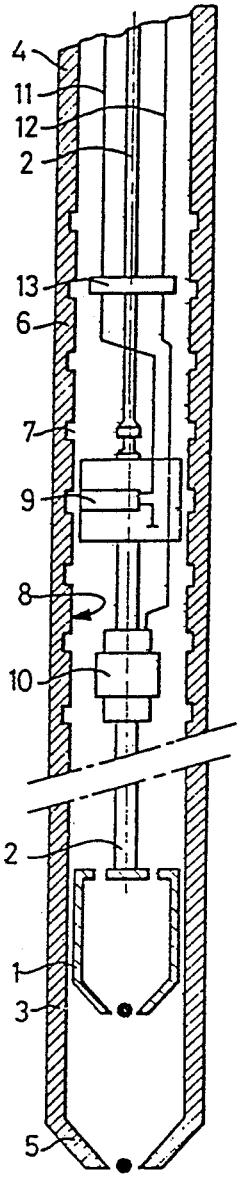
FIG. 1 is a schematic view in section of an experimental apparatus.

FIG. 1 is a schematic section of an experimental apparatus for measuring the displacement of movable equipment in a well. The movable equipment includes a piston 1 at the lower end of a column of sucker rods 2, which are movable in translation in the interior of a pump body 3 constituting the lower end of a production pipe 4. Pump body 3 has a check valve 5 at its lower end.

In the experimental apparatus of FIG. 1, the production pipe comprises a first element 6 having a series of grooves such as 7, formed in the inner surface 8 perpendicular to the axis of pipe 4. These grooves are equally spaced and constitute a fixed scale for a proximity sensor 9 secured to the sucker rod 2 for detecting its movement.

A short distance below the proximity sensor 9 whose function is to sense displacement, is a force sensor 10 which is installed in the sucker rods.

The displacement sensor 9 and the force sensor 10 are connected to the surface by electrical conductors in the form of insulated cables such as 11 and 12 maintained in place by regularly spaced centering members 13.

It is with such an experimental apparatus that it has been demonstrated that it is possible to obtain a graph or diagram of displacement v. force for the sucker rod situated immediately above the piston and that the quality of the diagram makes it an accurate instrument for optimizing the pumping parameters.

Figure 2:
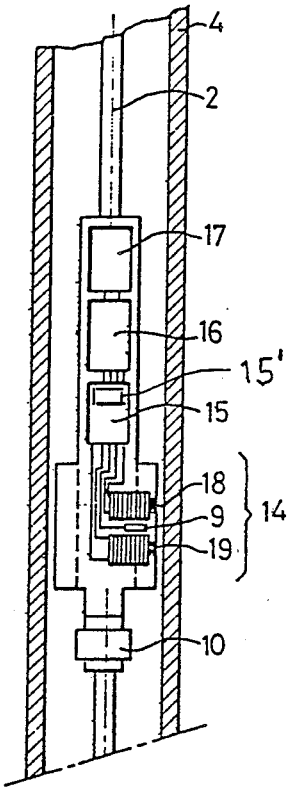
FIG. 2 shows the apparatus with the invention, including a detector and eraser of a magnetic mark on the production pipe, and which are operated by reversing the functions of creating and erasing.
Figure 3:
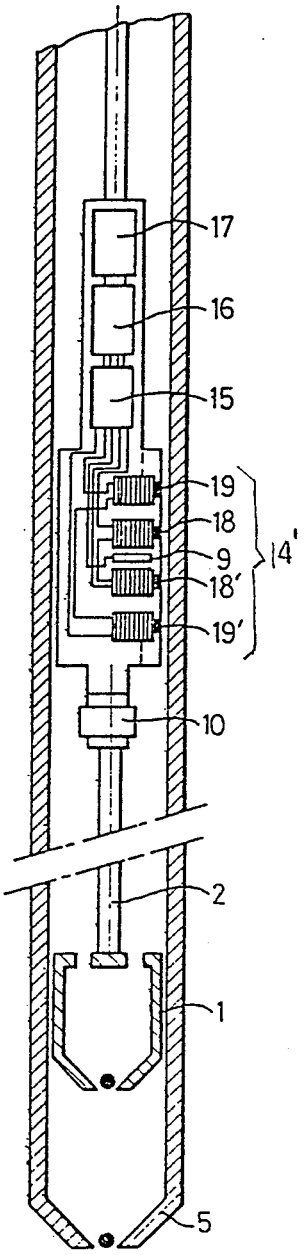
FIG. 3 shows an apparatus like FIG. 2 which is automatically reversible.

FIG. 3 shows a piston 1 at the end of a sucker rod column 2, movable in translation in the pump body 3 formed by the lower end of the production pipe 4. The pump body 3 has a check valve 5 at its lower end. This same arrangement is used with but not shown for the embodiment of FIG. 2, which will now be described.

The apparatus of FIG. 2, according to the invention, is constituted by a self contained assembly fixed to the movable equipment in the well pipe. As shown, the movable equipment constitutes a column of sucker rods 2, and the self contained assembly is fixed to a lower rod of the column. This self contained assembly includes a force sensor 10, an improved displacement sensor 14, auxiliary control means 15, and recording means 16 and power storing means 17 for storing the data and measured parameters. The pipe 4 of FIG. 2 is a production pipe of a well which has a relatively smooth interior surface. When the force sensing means is activated, the force or load on a lower sucker rod is continuously measured and recorded by the recording means 16.

The improved displacement sensor 14 includes two coils 18 and 19 situated the same distance respectively above and below a magnetic field sensor or detector 9. Each coil is operable as a magnetic mark creating means, or as a magnetic mark erasing means, and the reversal of these functions is controlled by the control means 15. During operation, one coil is operated to create and the other coil is operated to erase. Thus, during upward displacement of the pump rod the coil 18 is operated as a means for making magnetic marks on the inner wall of the production pipe, and the coil 19 is operated as a means for erasing the magnetic marks made by the coil 18. Similarly, during downward displacement of the sucker rod, the coil 19 is operated as a means for making magnetic marks on the inner wall of the production pipe, and the coil 18 comprises means for erasing the magnetic marks made by the coil 19.

Connected to the control means 15 is a sensor 15' to detect reversal of the direction of displacement of the sucker rod. This sensor 15', which can be an accelerometer or a sensor responsive to the load sensed by the force sensor 10, operates to signal the control means 15 each time the direction of displacement of the sucker rod is reversed, to switch the control means 15 in such a manner that the functions of the coils 18 and 19 is reversed each time the direction of displacement of the sucker rod is reversed.

In operation of the embodiment of FIG. 2, a signal from an operator at the surface activates the load or force sensor 10, and triggers the control means 15 ON, so that during upward movement of the rods 2, coil 18 creates magnetic marks on the inner wall of the pipe 4 and coil 19 erases the marks after they are detected by the detector 9. The ON signal briefly energizes coil 18 to create a magnet mark on the inner wall of the pipe. When detector 9 senses the magnet mark, a signal is sent to and recorded by the recording means, and simultaneously, a signal is sent to control means 15 to again briefly energize coil 18 to create another magnetic mark on the inner wall of the pipe at the new location of the coil 18. Such creation of a new magnetic mark each time a magnet mark is detected, is repeated during the entire upward movement of the rod. The coil 19 which follows the detector, passes over and erases the previously detected magnetic marks.

When the rod reaches the upper end of its travel the reversal of displacement detector 15' switches control means 15 to operate coil 19 as the magnetic mark creating coil, and coil 18 as the erasing coil, during downward movement of the rod. Control means 15, when it switches, briefly energizes coil 19 to form a magnetic mark on the inner wall of the pipe 4, and the detecting and creating of marks continues during downward displacement of the sucker rod. During downward displacement the magnetic marks created by coil 19 are erased by coil 18.

Each time a mark is sensed by the detector 9, the occurrence of the mark is recorded by the recording means 16, which also records the elapsed time between the recorded signals. Since the respective marks are each the same distance apart on the inner wall of the pipe, each recorded signal represents a displacement of the rod equal to the distance between the mark creating magnet and the detector 9. Where the coils 18 and 19 are each spaced 5 cm. from the detector 9, twenty marks are recorded per meter of rod displacement, which are more than adequate to plot an accurate Force v. Displacement graph or diagram.

FIG. 3 shows an apparatus similar to that of FIG. 2, but with a different embodiment of improved displacement detector 14' which functions both during descent and ascent of the sucker rod. This embodiment of detector 14' eliminates the need for installing the reversal of direction sensor 15', and the reversal of function switching of control means 15, which is required for the coils 18 and 19 used with the embodiment of FIG. 2.

The displacement sensor 14', as shown schematically at FIG. 3, comprises successively from top to bottom:

a coil 19 for erasing magnet marks from the inner surface of the pipe wall, a coil 18 for recording or creating magnetic marks on the inner surface of the pipe wall, a detector 9 for detecting the magnetic marks, a coil 18' for recording or creating magnetic marks on the inner surface of the pipe wall, a coil 19' for erasing magnet marks from the inner surface of the pipe wall.

This arrangement is symmetrical with respect to the axis of the detector 9. The magnetic mark creating coils 18 and 18' are connected in series to a circuit energized by a direct current for a very short excitation period to create a magnetic mark. The erasing coils 19 and 19' are connected in series to a circuit energized by a current whose frequency is at least five times that of the marking coils 18 and 18' and causes erasing of the magnetic pole marks on the inner wall of the production pipe 4.

It is preferred that the coils 18 and 18' create magnetic marks of opposite polarity. For example, the pole or magnetic mark created by coil 18 is a North (N) pole, and the pole or magnetic mark created by the coil 18' is a South (S) pole. The detector 9 senses the polarity of the mark and sends a corresponding + or − signal to the recording means 16. Thus, the direction of displacement of the sucker rod can easily be ascertained from the polarity of the recorded signals.

This arrangement of FIG. 3 operates as well during lowering as during lifting without the need for the reversal of the direction of travel switching required with the apparatus of FIG. 2.

The adoption of the apparatus of FIG. 3 greatly simplifies the mechanisms of control at the bottom of the well, and therefore the elimination of numerous sources of error or ambiguity in the reading of the data.

The auxiliary control means 15 are, for the apparatus according to FIG. 3, constituted by a trip mechanism device to start operation in response to a signal from the surface, for example, with a pressure shock. The stopping of the apparatus is programmed by the operator after the desired interval of measuring.

The recording means 16 preferably has volatile random access memory (R.A.M.) the data in which is preserved without change by the energy storage means 17, in the form of cells or lithium batteries, which maintains the memory continuously energized.

In operation of the embodiment of FIG. 3, during upward displaced of the sucker rod, both coils 18 and 18' are simultaneously briefly energized with a direct current from control means 15 to form a N polarity magnetic mark above detector 9 and a S polarity magnetic mark below detector 9. During upward displacement of the rod, only the N polarity marks created by the coil 18 are sensed by the detector, since the S polarity marks are formed behind the detector 9. Each time a mark is detected a plus signal is sent to the recorder, as explained above for the embodiment of FIG. 2, and simultaneously, control means 15 is signaled to briefly energize coils 18 and 18' to form additional magnetic marks. When the sucker rod moves upwardly, erasing coil 19 operates to remove any residual magnetism from the inner wall of pipe 4, and erasing coil 19' erases both S and N magnetic marks as it passes over them.

When the sucker rod in FIG. 3 reaches the top of its stroke and reverses to move downwardly, detector 9 senses the most recent S polarity mark formed by the coil 18', sends a minus signal to the recorder, and the coils 18 and 18' are briefly energized each time a mark is detected, as explained above. The S polarity marks made by the coil 18' are thus the only marks detected during downward displacement of the sucker rod, and the minus signals are recorded.

Since the force detected by the force sensor 10 is also recorded with respect to time, the direction of displacement can be determined from the load recording even if the magnetic marks formed by the coils 18 and 18' are of the same polarity. However, the correlation is simplified where the recorded direction of displacement marks are plus and minus respectively for the up and down displacements.

The distance between the pole axes of the erasing coil 19' and the magnetic mark creating coil 18', is preferably greater than the distance between the pole axis of coil 18' and the axis of detector 9 to assure that the last magnetic mark made by the coil 18' during upward displacement of the sucker rod is not erased when the sucker rod reverses direction and starts down. This assures the presence of a magnetic mark for detection by the detector 9 to initiate magnetic mark forming during downward travel. The distance between the coils 18 and 19 is the same as the distance between the coils 18' and 19', and the coils 18 and 18' are each the same distance from the detector. As an example, where the coils 18 and 18' are each 5 cm. from the axis of detector 9, the coil 19 is 8 cm. from coil 18, and coil 19' is 8 cm. from coil 18'.

Figure 4:
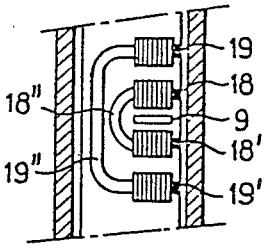
FIG. 4 shows in greater detail the induction coils of FIG. 3.

FIG. 4 shows the coils 18 and 18' for creating the magnetic poles on the internal wall of the production pipe 4, and also the coils 19 and 19' for erasing the magnetic poles from the internal wall. The coils 18 and 18' have a common core 18'' of non retentive magnet material, and the coils 19 and 19' have a common core 19'' of non retentive magnetic material. The respective cores 18'' and 19'' are U shaped and have their tips close to the inner wall of the pipe, but can be semi-elliptical. This arrangement assures a high efficiency operation of the electromagnet devices. The coils 18 and 18' are wound in a manner to assist each other so that the end of the core at coil 18 is a North pole and the end of the core at coil 18' is a South pole. The erasing coils 19 are 19' are also wound to assist each other.

Figure 6:
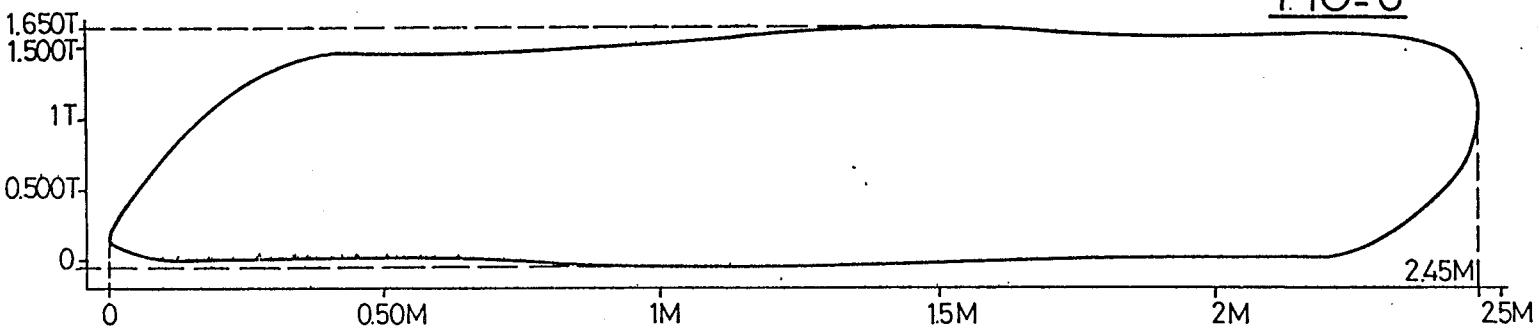
FIG. 6 is a diagram or graph of force v. stroke measured at the bottom.
Figure 7:
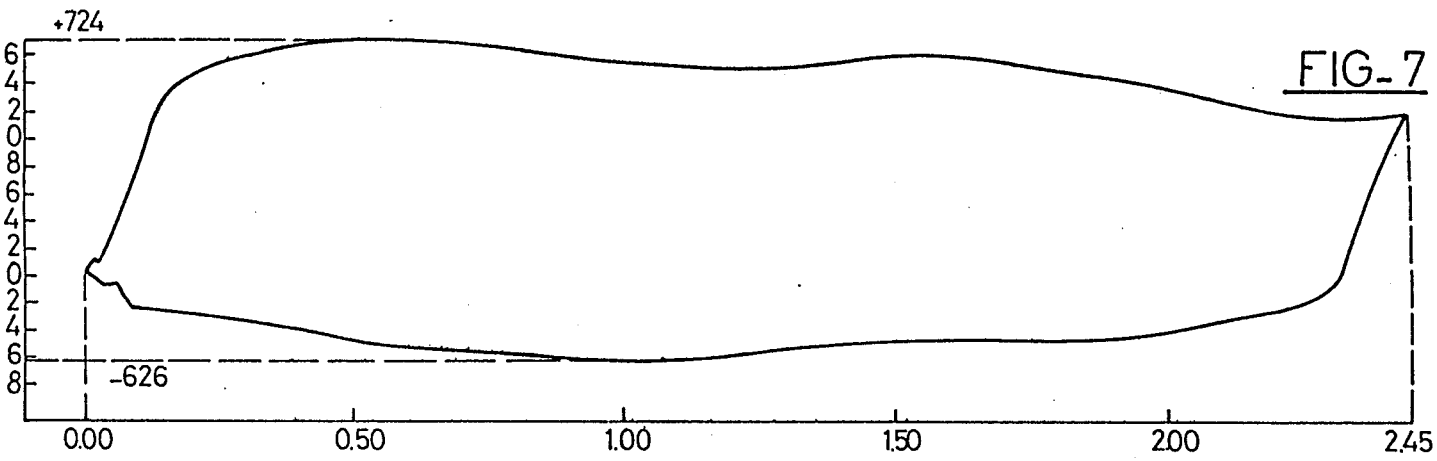
FIG. 7 is a diagram or graph of force v. stroke at the bottom calculated without friction.
Figure 8:
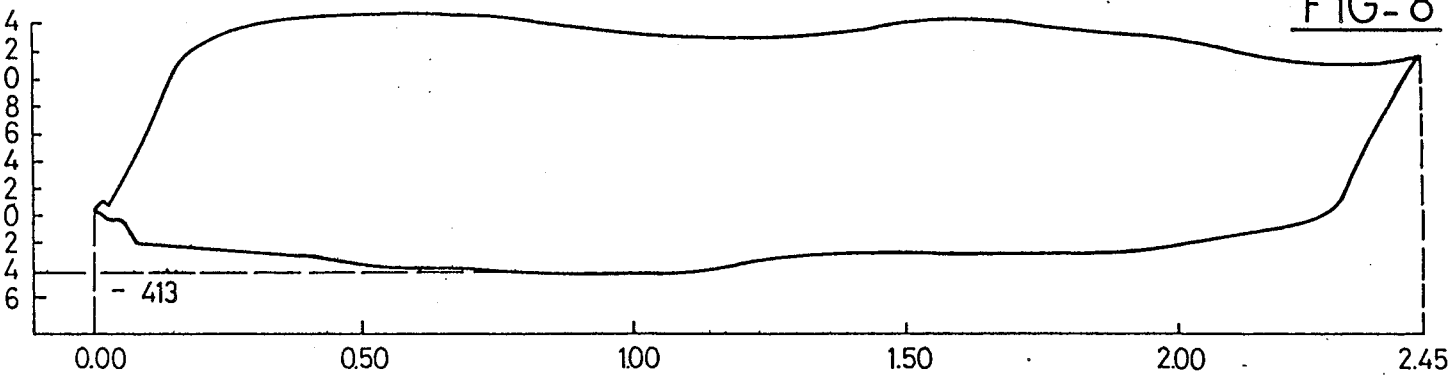
FIG. 8 is a diagram or graph of force v. stroke at the bottom calculated with friction.

FIGS. 5 to 8 permit establishing a comparison between the surface recording (FIG. 5), the bottom recording with the apparatus of the invention (FIG. 6), and surface recordings transformed by calculation without friction (FIG. 7), and transformed by calculation with friction (FIG. 8).

These diagrams or graphs, in the current technique, give, as abcissa the stroke in meters and as ordinate, the load of the pump in tons.

Figure 5:
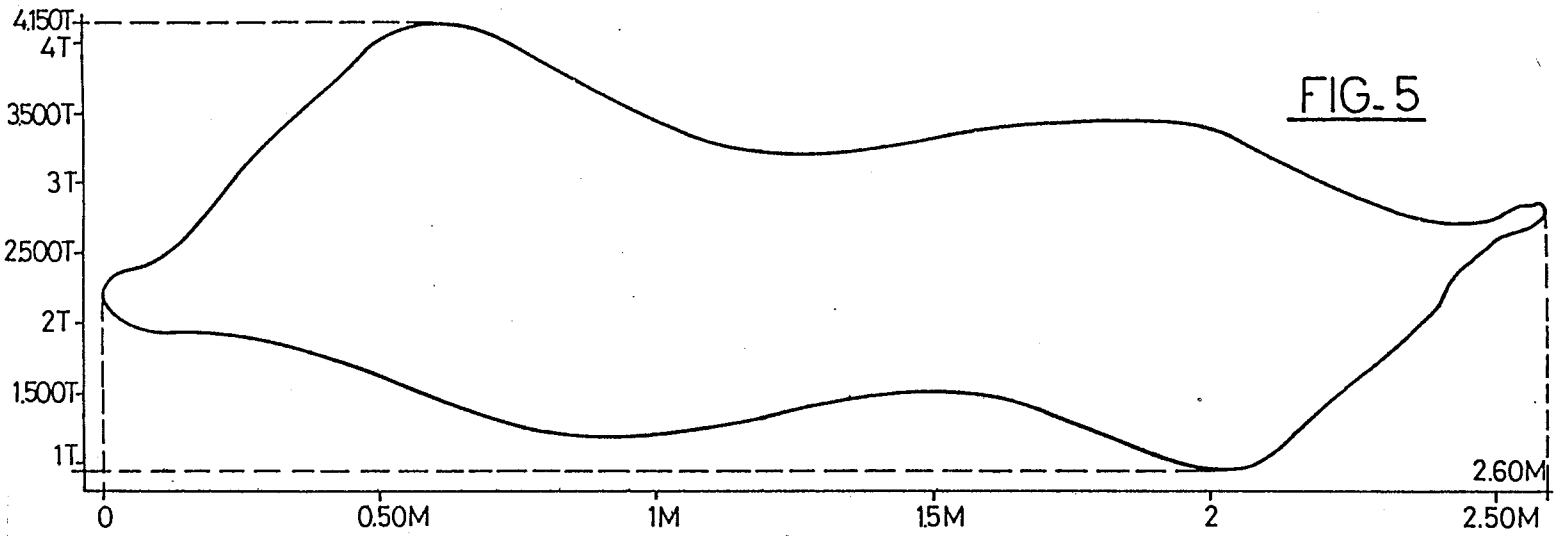
FIG. 5 is a diagram or graph of stroke v. force at the surface.

A comparison between the three bottom diagrams can be established with the following table:

| Chart | FIG. 5 | FIG. 6 | FIG. 7 |
|---|---|---|---|
| Stroke (meters) | 2.45 | 2.45 | 2.45 |
| Force min. − max. (+) | 1.650 | 2.33 | 1.916 |
| Force min. (+) | 0 | −0.626 | −0.413 |
| Force max. (+) | 1.650 | +1.704 | +1.503 |

The calculated strokes are good in each case and very close to the measured strokes.

The "rebounds" at the dead bottom point 0, which one sees in the calculated diagrams, do not appear in the diagram obtained by bottom measurement.

The true bottom diagram is much more regular than the diagrams by calculation starting with surface recordings, which shows that the absorption by the column is very effective.

The speed or velocity of the rod 2 at the bottom of the well can also be determined from the recorded data. This is done by comparing the spacing between marks with the elapsed time between the recording of successive marks. In this manner the velocity of the rod can be very accurately determined at any displacement position.

It is not necessary to point out that recording from the bottom enables deciding the entire objectivity of the modifications to make to the pumping parameters for vertical wells. It will be indispensable for analyzing the conditions of operation of the pump for inclined wells, since for these there do not exist reliable programs to transpose the surface measurements to the bottom.

A distinct advantage of the invention is that the apparatus and method can be used with any movable equipment in any existing well pipe, pump body, or production string without the need for pulling the string to install, for example, a modified body like that shown in FIG. 1. The apparatus is easily installed near the lower rod of the rod column by pulling the column, which is often required for periodic servicing of the pump. The absence of any modification to the well pipe or production pipe is a further advantage, since grooves such as those in the pipe of FIG. 1 are difficult to form in small diameter production pipe and tend to retard flow of the pumped well liquids.

While the invention has been shown and described as it is used to measure the displacement of movable equipment in which the movable elements are sucker rods connected to a piston of a pump near the bottom of a production well, the invention can be used to measure the displacement of any movable or displacable equipment within the pipe of a well.

While preferred embodiments are show and described, changes and modifications can be made without departing from the scope of the invention.

What is claimed is:

1. Apparatus to measure the displacement of a movable element of equipment in a pipe of a well and which reverses direction in the pipe, said apparatus comprising, first means connected to the movable element for creating a magnetic mark on the inner wall of the pipe, detecting means connected to the movable element and at a predetermined distance from the first means for detecting a magnetic mark, second means connected to the movable element and at a predetermined distance from the detecting means for erasing magnetic marks from the inner wall of the pipe, and means for detecting a reversal of the direction of displacement of the movable element for reversing the operational functions of the means for creating magnetic marks and the means for erasing magnetic marks, so that the erasing means operates as a magnetic mark creating means, and the creating means operates as a magnetic mark erasing means, said means for detecting reversal of the direction of displacement comprising a sensor spaced apart from the inner wall of the pipe.

2. Apparatus according to claim 1, further comprising means for immediately energizing the mark creating means to form a magnetic mark on the wall of the pipe upon reversing of said operational functions.

3. Apparatus according to claim 1 further comprising, recording means connected to the movable element for recording output signals of the detecting means in response to detection of the magnetic marks.

4. Apparatus according to claim 3 further comprising, means for recording the elapsed time between detection of the magnetic marks by the detecting means.

5. Apparatus according to claim 3 further comprising, load sensing means connected to the movable element, and means for recording the load on the movable element sensed by the load sensing means.

6. Apparatus to measure the displacement of a movable element of equipment in the pipe of a well and which reverses direction in the pipe, said apparatus comprising, first means connected to the movable element for creating a magnetic mark of a first polarity on the inner wall of the pipe, second means connected to the movable element and spaced axially below said first means, for creating a magnetic mark different from said first polarity on the inner wall of the pipe, detecting means, between and spaced from said first and second means, for detecting said magnetic marks formed on the inner wall of the pipe by said first and second means and the polarity thereof, first magnetic mark erasing means above said first means, for erasing magnetic marks formed on the inner wall of the pipe, and second magnetic mark erasing means below said second means, for erasing magnetic marks formed on the inner wall of the pipe, whereby, a change of polarity of a detected mark is indicative of a reversal of direction of the movable equipment in the well.

7. Apparatus according to claim 6 further comprising means for simultaneously energizing said first and second means to create said different polarity magnetic marks on the wall of said pipe.

8. Apparatus according to claim 6 wherein, said first and second means each comprise, inductor means having magnetic axes orthogonal to the inner wall of the pipe, and means for briefly energizing said inductor means with an electric current to form a magnetic mark on the inner wall of the pipe.

9. Apparatus according to claim 8 wherein said first and second means are each spaced the same distance from the said magnetic mark detecting means.

10. Apparatus according to claim 6 wherein said first magnetic mark erasing means is spaced a greater distance above the first means than the first means is spaced from the detecting mean, and said second magnetic mark erasing means is spaced a greater distance below the second means than the second means is spaced from the detecting means.

11. Apparatus according to claim 9 wherein the first and second erasing means are each spaced the same distance from the detecting means.

12. Apparatus according to claim 8 wherein said inductor means comprise first and second coils at the opposite ends of a generally U-shaped magnetic core, said first coil creating a magnetic mark of said first polarity, and said second coil creating a magnetic mark of said second polarity.

13. Apparatus according to claim 12 wherein, said first and second erasing means comprise first and second coils at the opposite ends of a generally U-shaped magnetic core.

14. Apparatus according to claim 6 wherein, said movable element comprises a sucker rod connected to a piston in the well pipe for pumping the well.

* * * * *